US008069620B2

(12) United States Patent
Kelly et al.

(10) Patent No.: US 8,069,620 B2
(45) **Date of Patent: *Dec. 6, 2011**

(54) HEIGHT-ADJUSTABLE, STRUCTURALLY SUSPENDED SLABS FOR A STRUCTURAL FOUNDATION

(75) Inventors: Mike Kelly, Austin, TX (US); Tony Childress, Plano, TX (US)

(73) Assignee: CESlab, Inc., Richardson, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/896,182

(22) Filed: Oct. 1, 2010

(65) Prior Publication Data

US 2011/0020068 A1 Jan. 27, 2011

Related U.S. Application Data

(63) Continuation of application No. 11/462,031, filed on Aug. 2, 2006, now Pat. No. 7,823,341.

(60) Provisional application No. 60/705,846, filed on Aug. 4, 2005.

(51) Int. Cl.
*E02D 35/00* (2006.01)

(52) U.S. Cl. ..... 52/126.5; 52/745.2

(58) Field of Classification Search ..... 52/745.2, 52/126.5, 126.6, 126.7; 405/229, 230, 232, 405/235

See application file for complete search history.

(56) References Cited

U.S. PATENT DOCUMENTS 1,948,600 A * 2/1934 Templeton ..... 52/126.6
2,115,824 A * 5/1938 McRorey ..... 254/98
2,380,692 A * 7/1945 Gunnison ..... 52/126.6
2,686,420 A * 8/1954 Youtz ..... 52/125.1
3,036,816 A * 5/1962 Stubbs et al. ..... 254/89 R
3,040,411 A * 6/1962 Messenger ..... 405/229
3,152,366 A * 10/1964 McCrory et al. ..... 52/79.4
3,371,902 A * 3/1968 Hartwick ..... 52/157
3,594,965 A * 7/1971 Saether ..... 52/125.1
3,713,265 A * 1/1973 Wysocki et al. ..... 52/745.14
3,722,169 A * 3/1973 Boehmig ..... 52/745.04
3,852,970 A * 12/1974 Cassidy ..... 405/230
4,011,705 A * 3/1977 Vanderklaauw ..... 52/745.08
4,067,448 A * 1/1978 Bergeron, Jr. ..... 414/12
4,204,711 A * 5/1980 Lancelot et al. ..... 294/89
4,301,630 A * 11/1981 Burkland ..... 52/125.1
4,549,385 A * 10/1985 Cohen et al. ..... 52/741.11
4,800,700 A * 1/1989 May ..... 52/741.15
4,832,315 A * 5/1989 Vanderklaauw ..... 254/89 H
5,120,163 A * 6/1992 Holdeman et al. ..... 405/230
5,155,954 A * 10/1992 Roire ..... 52/125.5
5,174,083 A * 12/1992 Mussell ..... 52/169.1
5,205,673 A * 4/1993 Bolin et al. ..... 405/230
5,269,630 A * 12/1993 Bolin et al. ..... 405/230
5,623,792 A * 4/1997 Crumpacker ..... 52/126.7
5,724,781 A * 3/1998 Matthias et al. ..... 52/741.11
5,800,094 A * 9/1998 Jones ..... 405/230
5,860,254 A * 1/1999 Westhoff et al. ..... 52/125.4
6,082,058 A * 7/2000 Deng ..... 52/125.1
6,094,873 A * 8/2000 Hoffman et al. ..... 52/126.6

(Continued)

*Primary Examiner* — Robert Canfield
*Assistant Examiner* — Christine T Cajilig
(74) *Attorney, Agent, or Firm* — Fenwick & West LLP

(57) ABSTRACT

To form a new structurally suspended slab or to raise an existing slab for a structural foundation, structural supports are placed in the ground. The structural supports are attached to lifting assemblies, which are also installed in the slab. Actuation of the lifting assembly allows the slab to be raised and/or lowered, thereby forming a suspended slab over a void of a desired size. Existing slabs may be repaired using similar techniques.

28 Claims, 9 Drawing Sheets

U.S. PATENT DOCUMENTS 6,142,710 A * 11/2000 Holland et al. ..... 405/230
6,193,442 B1 * 2/2001 May ..... 405/232
6,260,311 B1 * 7/2001 Vladikovic ..... 52/122.1
6,434,893 B1 * 8/2002 Quenzi ..... 52/126.1
6,503,024 B2 * 1/2003 Rupiper ..... 405/230
6,705,053 B2 * 3/2004 Dimitrijevic ..... 52/126.6
6,767,167 B1 * 7/2004 Rials ..... 405/244
6,792,734 B2 * 9/2004 Zambelli et al. ..... 52/698
6,814,524 B1 * 11/2004 Peterson ..... 405/230
6,923,599 B2 * 8/2005 Kelso ..... 405/230

* cited by examiner

HEIGHT-ADJUSTABLE, STRUCTURALLY SUSPENDED SLABS FOR A STRUCTURAL FOUNDATION

CROSS REFERENCE TO RELATED APPLICATIONS

This application is a continuation of U.S. application Ser. No. 11/462,031, filed Aug. 2, 2006, now U.S. Pat. No. 7,823,341, which claims the benefit of U.S. Provisional Application No. 60/705,846, filed Aug. 4, 2005, each of which is incorporated by reference in its entirety.

BACKGROUND

This invention relates generally to structural foundations, and in particular to height-adjustable, structurally suspended slabs for structural foundations.

Structural foundations for residential and light commercial construction are typically designed as either "slab-on-grade" or as "structurally suspended slabs." Slab-on-grade designs, in which a foundation is constructed and supported directly on the ground, is very cost effective but is also heavily dependent on soil strength and soil stability. Slab-on-grade is also very maintenance intensive and, due to a variety of issues, has historically resulted in a significant amount of litigation. Suspended slabs, on the other hand, are isolated from soil movement and/or problematic soils because they do not sit directly on the ground, but they are very costly relative to slab-on-grade foundations. Suspended slabs involve over-excavating a site and constructing extensive, temporary form work and/or using void boxes to create a void or space between the foundation and the soil. The concrete is poured over the temporary form or void box and allowed to set. This process is labor intensive, adds significantly to construction time and costs, and has no provision for future adjustments of the foundation's height.

SUMMARY OF THE INVENTION

To avoid the problems associated with existing foundation technologies, including the slab-on-grade and structurally suspended slab types, embodiments of the invention incorporate a lifting process that allows slabs for a foundation to be formed on a ground surface and then lifted to a desired height. This enables the slabs to be formed like the cheaper slab-on-grade type but perform like the more expensive suspended slab type. In this way, the construction cost for the foundation may be kept relatively low, yet the foundation may perform like more expensive systems.

In one embodiment for forming a new foundation, a flat-slab is formed on a graded pad site so that it rests on structural support base. Various structures may be used for the structural support base, including but not limited to piers, spread footings, and rock. Lifting mechanisms are attached to the support base and mechanically coupled to the slab. Various types of lifting mechanisms may be used. By actuating the lifting mechanisms, the foundation can be raised above the ground, thereby creating a void between the foundation and the ground. This provides an economical concrete slab foundation that can be installed on top of the ground and then elevated or suspended a certain distance above the supporting grade.

In another embodiment, an existing foundation can be retrofitted with a lifting mechanism. A support base and a set of lifting mechanisms are installed in an existing foundation. Once installed, the lifting mechanisms allow the foundation to be raised and/or lowered to facilitate adjustment or repair of the foundation. These lifting mechanisms provide a relatively simple and inexpensive method to adjust the height of a foundation at a later time if needed.

The features and advantages described in this summary and the following detailed description are not all-inclusive. Many additional features and advantages will be apparent to one of ordinary skill in the art in view of the drawings, specification, and claims hereof. For example, embodiments of the invention incorporate various types of structural supports and lifting mechanisms, and they may include seismic damping and/or isolated plumbing with the suspended slabs.

The figures depict various embodiments of the present invention for purposes of illustration only. One skilled in the art will readily recognize from the following discussion that alternative embodiments of the structures and methods illustrated herein may be employed without departing from the principles of the invention described herein.

DETAILED DESCRIPTION OF THE PREFERRED EMBODIMENTS

Forming a New Foundation

Figure 1A:
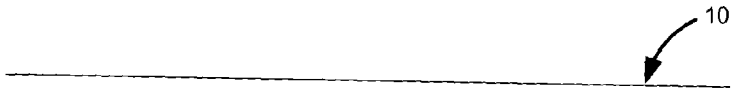
FIGS. 1A through 1E illustrate a process for constructing a new foundation over a pad site, in accordance with an embodiment of the invention.
Figure 1B:
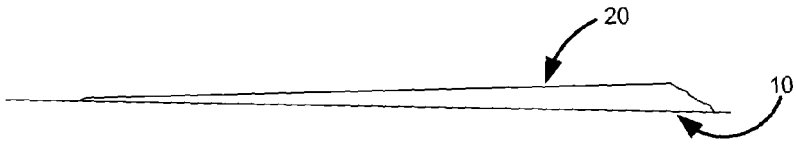

FIGS. 1A through 1E illustrate a process for constructing a new foundation, in accordance with an embodiment of the invention. FIG. 1A illustrates a location of natural ground 10 where the new foundation is to be formed. Because natural ground 10 is typically not level, a pad site 20 where the foundation is to be formed is shaped into a relatively smooth and level condition. As illustrated in FIG. 1B, the creation of the level pad site 20 may be performed using fill soil; however, other methods of creating a level pad site 20 may be used. The final grade elevation of the pad site 20 may be determined by the desired final elevation of the slab after it is raised into place.

Figure 1C:
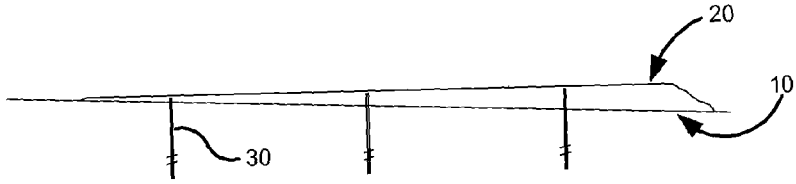
Figure 1D:
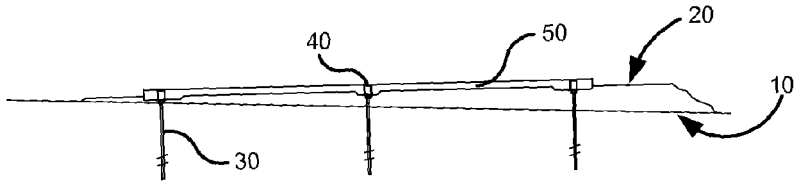

As shown in FIG. 1C, structural supports 30 are installed into the ground 10 at spaced-apart locations. The layout and spacing of the structural supports 30 may be determined according to the design of the structural concrete slab, among other design parameters. As described in more detail below, various types of structural supports 10 may be used, including various types of piers and spread footings. The top of each structural support 30 may be cut off or otherwise placed at the same elevation throughout the slab 50, where the elevation is determined according to the desired void 60 and the desired elevation of the finished slab 50. Once the structural supports 30 are in place, lifting assemblies 40 are installed over the structural supports 30. Various embodiments of lifting assemblies 40 are described in more detail below.

Before the concrete for the slab 50 is poured, perimeter form boards are set in place around the slab 50 to be formed. In one embodiment, post-tension cables and/or rebar reinforcement members are installed as desired. As described in more detail below, piping for sewer drainage and water supply may be installed before the concrete is poured. Any electrical conduits may also have "leave outs" or other mechanisms allowing for lifting of the slab 50. Once forms are built around the desired foundation, concrete is poured to cast the slab 50 on top of the pad site 20, using the fill soil as the bottom of the form. A concrete perimeter skirt may be cast around the perimeter of the slab 50 at this time or may be added later.

In one embodiment, "lightweight" concrete is used, allowing the slab 50 to be more easily lifted above the ground. Fiber additives may also be useful to control stresses and surface cracking, especially in areas where there are perimeter setbacks or where the pier spacing is not uniform. However, various types of concrete, mixtures, or other appropriate slab materials may be used in other embodiments.

In one embodiment, the slab 50 is designed as a post-tensioned, two-way flat slab having column capitals (thickened slab depth) but no stiffener beams except for the perimeter beam. The slab thickness may vary depending on loads, span, and strength of the concrete, where a typical thickness in one embodiment ranges from 5 to 7 inches. The added depth of slab makes it possible to place the cables with a profile or drape over and between the pier supports. In this way, the cables exert a net uplift onto the slab system along the tendon path in addition to the pre-compression that the tendons impart to the slab at the slab edges. Alternatively, the slab may comprise conventionally reinforced concrete.

Figure 1E:
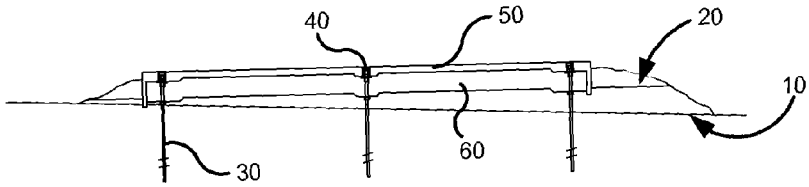

Once the poured concrete reaches adequate strength, the slab 50 will become fixed to the lifting assemblies 40, which in turn are supported by the support structures 30 fixed in the ground 10. The slab 50 may then be lifted above the level pad site 20 by actuation of the lifting assemblies 40. As shown in FIG. 1E, the slab 50 is raised a specified amount using the lifting assemblies 40. This lifting of the slab 50 creates a void 60, which is determined by the distance from bottom of the slab 50 to top of the pad site 20 after the slab 50 is raised. The size of the void 60 under the slab may be calculated from soil reports or based on other factors as desired by the building engineer.

As described above, an elevated structural slab 50 is constructed, permanently supported by a set of lifting mechanisms 40, which, in turn, transfer the load to the support structures 30 and into the supporting soil.

Figure 2:
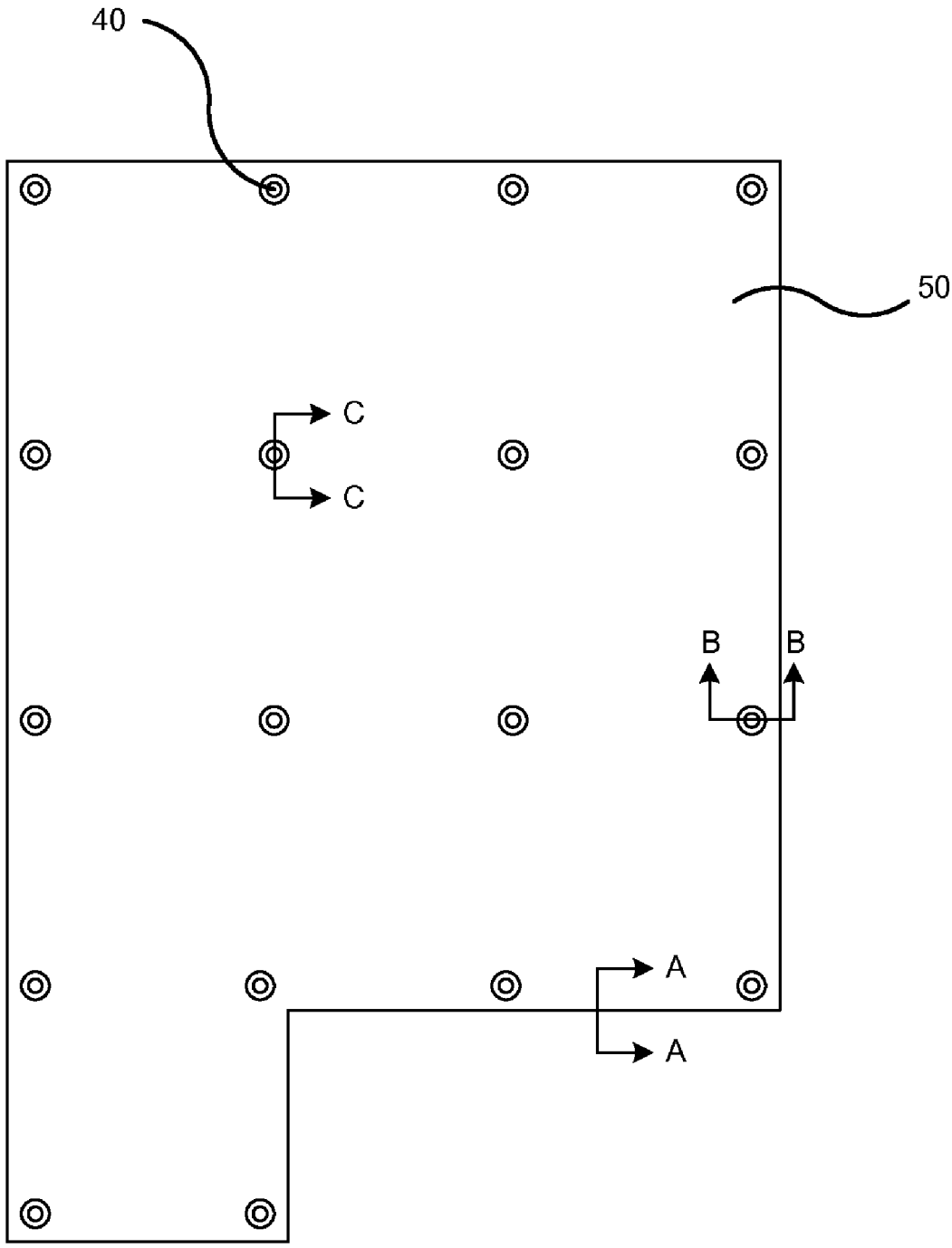
FIG. 2 is a plan view of an adjustable slab, in accordance with one embodiment of the invention.

FIG. 2 is a plan view of one embodiment of an adjustable slab 50, which may be formed according to the process of FIGS. 1A through 1E. This plan view illustrates the placement of structural supports 30 (and their corresponding lifting assemblies 40) in relation to the slab 50, in accordance with one embodiment of the invention. The structural supports 30 include exterior supports placed along or near the perimeter of the slab 50 as well as interior supports located in a middle section of the slab 50. The exterior and interior structural supports 30 are preferably situated so that they do not conflict with interior walls, plumbing pipes, or other components of the slab foundation 50. This may be determined based on the architectural drawings for the structure.

For example, the perimeter structural supports 30 may be offset a certain distance from the outside edge of the slab 50 (e.g., inset by about 15 inches) to avoid conflicting with the exterior walls of the structure to be built on the slab 50. This is designed so that any future exterior walls will not interfere with the placement of the lifting mechanisms 40, thereby allowing access to the lifting mechanisms 40 after the structure is built.

Figure 3A:
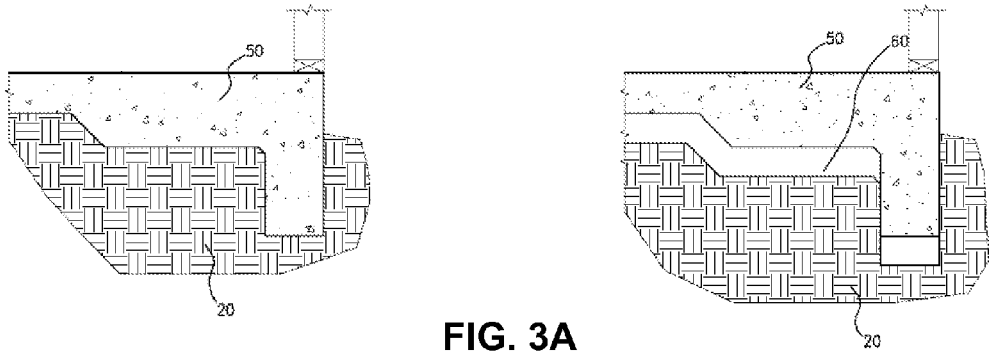
FIGS. 3A through 3C illustrate cross sections of different portions of the adjustable slab of FIG. 2, before and after lifting, in accordance with an embodiment of the invention.
Figure 3B:
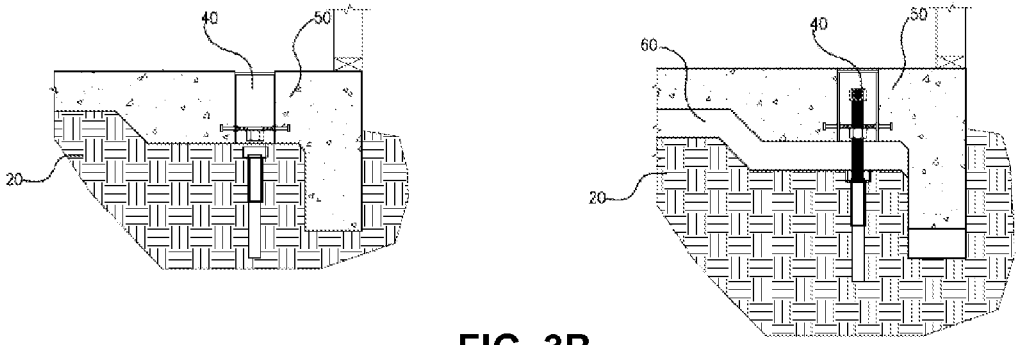
Figure 3C:
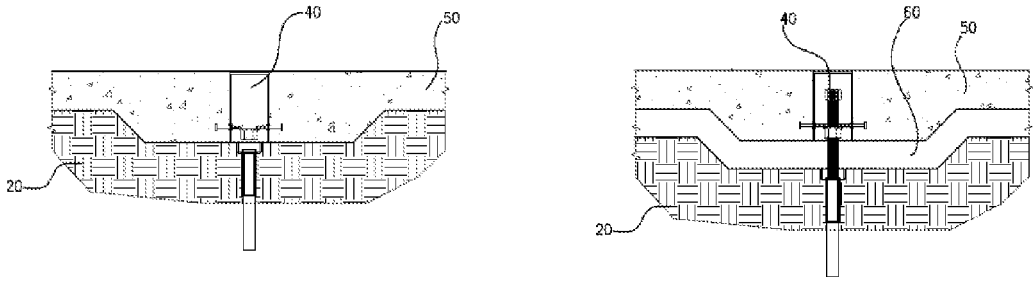

FIGS. 3A through 3C illustrate cross sections of the slab 50 shown in FIG. 2, along the lines A-A, B-B, and C-C, respectively. FIG. 3A shows the void 60 created near the perimeter of the slab 50 when the slab 50 is lifted by the lifting assembly 40. FIG. 3B illustrates the lifting of the slab 50 by a lifting assembly 40 along the perimeter of the slab 50, and FIG. 3C illustrates the lifting of the slab 50 by a lifting assembly 40 at an interior section of the slab 50. In a typical lifting operation, the lifting assemblies 40 are all raised, thereby creating the void 60 under the entire area of the slab 50.

In addition to the added ability to profile the cables, embodiments of the invention offer other design advantages that may result in maximizing the economy of the structural materials used. In the past, "assumed" soil forces, rather than the actual loads supported by the structure, governed a typical slab-on-grade design. In embodiments of the invention, the soil forces are essentially removed from the equation, and the design may be based solely on the more accurate dead and live loading from the structure itself. Moreover, the entire foundation system can be designed as a single, homogeneous unit. By varying the slab thickness and the structural support spacing, a significant economy of materials can be obtained for different foundation sizes and shapes. Typically, much less concrete is required, and the supports can be spaced significantly farther apart compared to previous suspended slab designs.

As another benefit, additional time can be saved by eliminating the need to dig trenches for stiffener beams. The absence of trenches means fewer delays due to rain. Moreover, in an embodiment utilizing a post-tensioned, two-way flat slab, much greater quality control and control over construction tolerances is possible than with previous void box construction methods.

Moreover, water supply piping may be installed above the top of the slab 30 through the walls and attic space. This system allows all of the piping to be tied to or run above the slab, and it essentially isolates the piping from the affects of soil movements.

Structural Supports

The structural supports 30 in the embodiment of FIGS. 1A through 1E and 3A through 3C comprise simple piers, which can be fixed into the ground to provide a stable support base to support the load of the foundation and a structure resting thereon. However, many other types of structural supports may be used to provide such a support base. Examples of other types of structural supports include, without limitation, helical piers, drilled shaft piers, pressed concrete or steel pilings, spread footings or even natural rock. It will be appreciated by those of skill in the art that many other types of support structures may be used in other embodiments of the invention.

Figure 4:
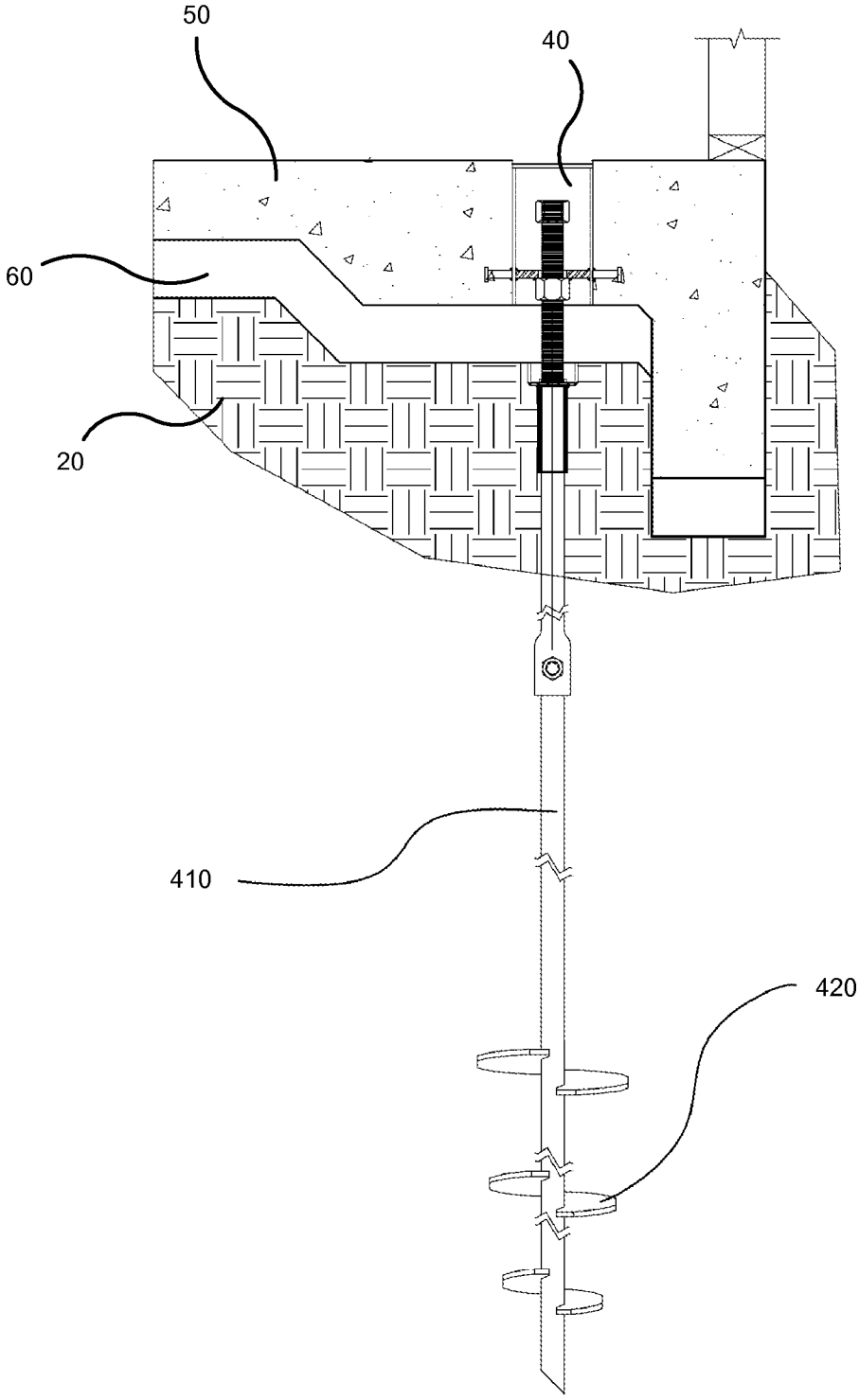
FIG. 4 illustrates a helical pier support structure, in accordance with an embodiment of the invention.

FIG. 4 illustrates a helical pier used as the support structure in one embodiment of the invention. The helical pier comprises a shaft 410 having a system of helical-shaped plates 420 attached to the shaft 410. The shaft 410 and plates 420 are typically formed from a strong material, such as steel, and the plates 420 may be welded to the shaft 410. The helical pier can be fixed into the ground using a rotating torque device to turn the helical pier, effectively screwing the pier into the ground until it reaches a desired depth.

Figure 5:
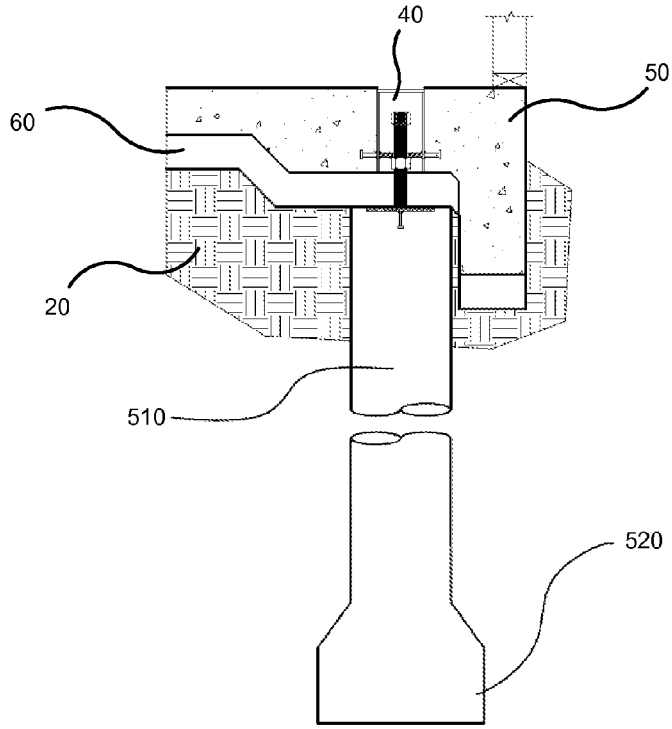
FIG. 5 illustrates a drilled shaft pier support structure, in accordance with an embodiment of the invention.

In another embodiment of the invention, FIG. 5 illustrates a drilled shaft pier used as the support structure. The drilled shaft pier may be formed by drilling a hole in the ground to an appropriate depth. This hole may be drilled using, for example, a rotary auger drill shaft. Concrete is poured into the hole, which serves as a form for the resulting concrete shaft 510. The hole may also be filled with rebar for reinforcement. The drilled shaft may also be widened at the bottom, which results in a widened base structure 520. The widened base structure 520 provides additional bearing and helps prevent uplift of the pier.

Figure 6:
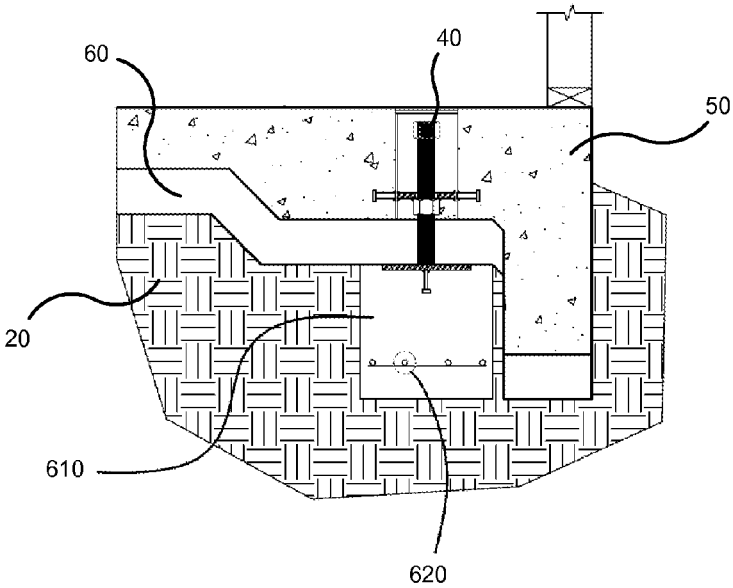
FIG. 6 illustrates a spread footing support structure, in accordance with an embodiment of the invention.

FIG. 6 illustrates a spread footing used as the support structure in yet another embodiment of the invention. The spread footing can be constructed near the surface of the ground by excavating a square void in the soil of a specified depth and area. The void is then filled with concrete 610, and rebar 620 may be used to provide reinforcement. When set, the spread footing can be used for the support structure for the suspended slab system.

Lifting Assemblies

Figure 7B:
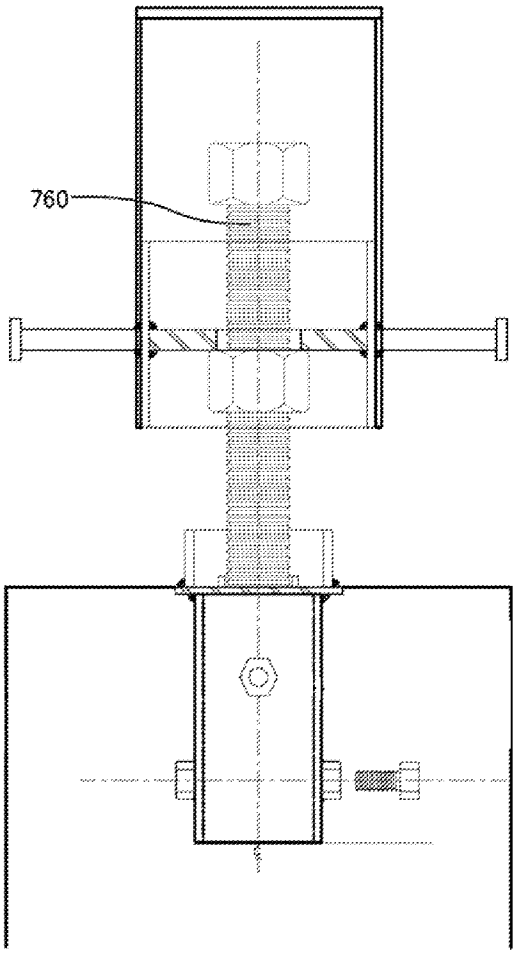
FIGS. 7A and 7B illustrate a lifting assembly in standard and raised positions, respectively, in accordance with an embodiment of the invention.
Figure 7A:
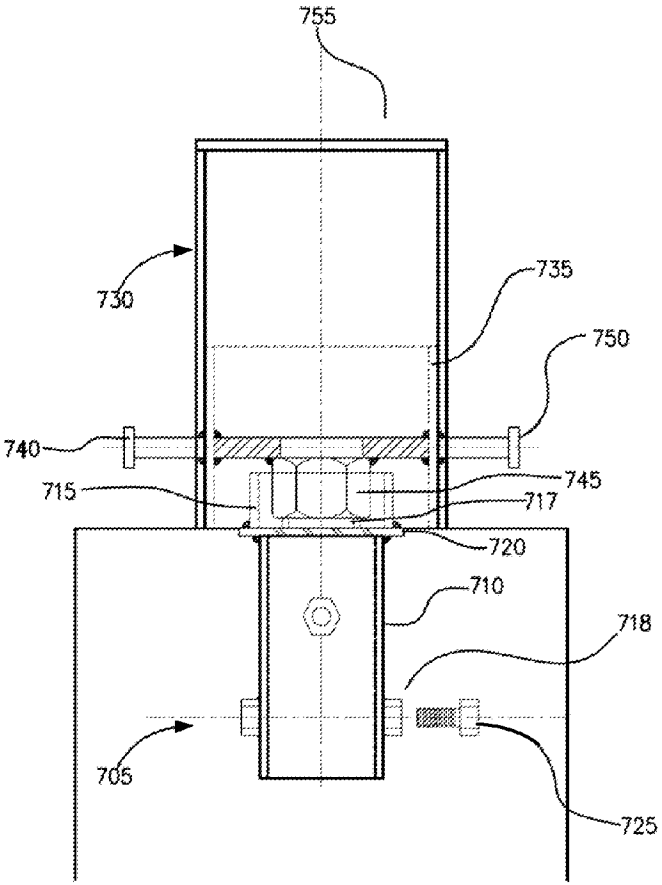

FIGS. 7A and 7B illustrate an embodiment of a lifting assembly designed to fit over a helical pier, in accordance with an embodiment of the invention. In one embodiment, each lifting assembly comprises two main sections, a pier cap portion 705 and an anchor portion 730. The pier cap portion 705 comprises a short length of pipe 710 that is welded to another section of tubing 715 with a metal plate 720 therebetween. The pipe 710 is designed to fit over the top of a helical pier shaft; however, the lifting assembly may be adapted to fit with other types of structures used for the support base. The pipe 710 may further include a threaded hole for receiving a set screw 725, which can be used to secure the pier cap portion of the lifting assembly to a pier.

The anchor portion 730 of the lifting assembly comprises a short length of pipe 735 that includes stud anchors 750 welded along the outside. The stud anchors 750 are designed to be cast into the concrete slab so that the anchor portion 730 of the lifting assembly is firmly fixed to the slab. A plate 740 is welded within the pipe 735. The plate 740 is welded to a nut 745 on the opposite end of the pipe 735, and a hole is drilled through the plate 740 that is large enough to allow a threaded rod to pass through and mate with the nut 745. The nut 745 is designed to fit within the section of pipe 715 of the pier cap portion 705 of the lifting assembly.

To install the lifting assemblies, each lifting assembly is placed over a pier. A protective cap 755 is temporarily placed over the pipe 735 to prevent entry of concrete into the lifting assembly. In one embodiment, the lifting assemblies are set over each pier so as to be cast into the concrete slab about one half inch below the finished surface of the slab. The assemblies are adjusted to a plumb position and for helical piers, the adjustment screws 725 are tightened to secure the assemblies in position and to prevent movement when the concrete is placed. Once the concrete is poured and cured, the anchor portion 730 becomes structurally secured to the slab.

To raise the slab, as illustrated in FIG. 7B, the protective cap 755 is removed from the top of each of the lifting assemblies. For each lifting assembly, a lifting bolt 760 is screwed into and through the nut 745 at the bottom of the lifting assembly until the bottom of the bolts 760 rest against the plate 720 over the top of the pier. The lifting bolt 760 is then screwed further through the nut 745, causing the slab to be lifted as illustrated in FIG. 7B. The lifting of the slab due to the lifting of each of the lifting assemblies creates the desired void between the bottom of the slab and the soil. In one embodiment, the bolts 760 have ACME series threads, which require less input torque for a given load than other types of power screws and thus offer a greater mechanical advantage.

In the embodiment described herein, the pier cap portion 705 serves as the interface between the lifting assembly and the support structure. The lifting assembly illustrated in FIGS. 7A and 7B is designed to fit over a helical pier or other similar support structure. If the lifting assembly is used with another type of support structure, such as a drilled shaft pier or spread footing, the pier cap portion 705 may be removed or simply replaced with a plate over the support structure. Upon actuation, the lifting bolt 760 then pushes against the plate on top of the support structure (as opposed to the pier cap portion 705), thereby causing the lifting assembly and slab to raise.

The length of the lifting bolts 760 can be selected according to the required void height. The length is preferably set at a dimension such that, once the required void height is attained, the center of the head of each bolt 760 is situated in a position equidistant from the bottom and top of the upper pipe portion of the lifting mechanism. In this way, should future foundation movement occur, the bolt 760 can be accessed from above and the foundation can be raised or lowered to compensate for this movement. The equidistant positioning provides an equal ability to raise and lower the slab.

Preferably, the lifting bolts 760 are turned at the same time so that the slab is raised in a uniform fashion. In one embodiment, electric or hydraulic torque wrenches are placed onto the head of each lifting bolt 760. By applying power to all of the wrenches at the same time, the entire slab can be lifted, as one unit, to the desired height. The wrenches may be connected to a central monitoring assembly so that each wrench can be monitored and caused to turn in unison. This minimizes any torque placed on the slab that may otherwise be induced into the slab during the raising process. Alternatively, each bolt 760 may be turned by hand with a drive socket wrench.

In one embodiment, the lifting assemblies are coupled to a programmable automatic lifting system, which comprises a computer system that controls the actuation of the lifting bolts 760 or any other lifting mechanism used by the lifting assembly. The automatic lifting system receives a user selection for a desired amount of lifting of the slab. The system further includes elevation sensors to measure the amount that the slab has been raised at one or more of the lifting assemblies. This measured elevation is used as a feedback signal to control more precisely the lifting of each lifting assembly. The system then actuates each of the lifting assemblies to maintain a level condition during the lifting process until the slab is raised to the desired elevation. This reduces any potential for racking and binding of the slab during the lifting process. The automatic lifting system may be powered by electric, battery, fuel, or any other power means and may actuate the lifting assemblies using air, hydraulic, or other pressure type devices.

In one embodiment, the lifting bolts 760 are specially designed so that only corresponding specially designed torque wrenches can be used to turn the lifting bolts 760. This helps to disallow people who were not involved with building the foundation from adjusting the lifting bolts 760, since these people are less likely to understand how to adjust the bolts 760 properly. In this way, liability and danger from improper use of the adjustable slabs can be reduced. The lifting bolts 760 and torque wrenches can be specially designed, for example, by designing a customer interface between the bolt head and wrench so that normal wrenches cannot be used to turn the bolts 760.

The lifting assembly may be coated to prevent corrosion, or it can be constructed of a non-corrosive material. The protective cap 755 is may be replaced on the top of the lifting assembly to provide additional protection after the slab is raised. A protective coating may also be applied to the lower portion of the bolt 760 under the slab to ensure that the bolt will turn freely in the future if later adjustments to the slab elevation are desired.

Although lifting assemblies incorporating lifting bolts have been described, other embodiments of the invention may incorporate other types of mechanisms to lift the slab. For example, the lifting systems may comprise jacking systems that are installed under the slab before the concrete is poured. The jack is placed over a support structure, such as a pier, and then used to raise the slab after the concrete is set. The jacks thus supply the force necessary at each lift point to lift the slab.

Figure 8:
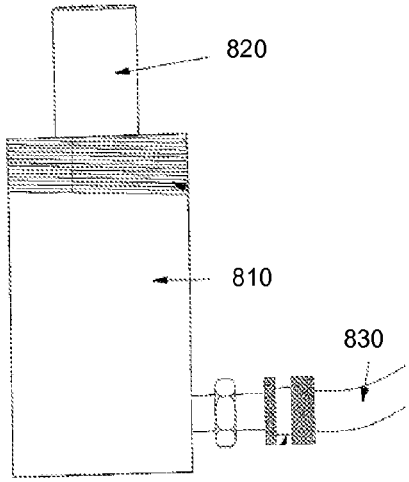
FIG. 8 illustrates a hydraulic jack lifting assembly, in accordance with an embodiment of the invention.
Figure 9:
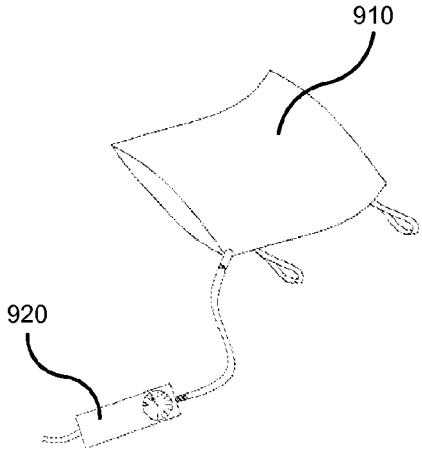
FIG. 9 illustrates an air-inflatable jack lifting assembly, in accordance with an embodiment of the invention.
Figure 10:
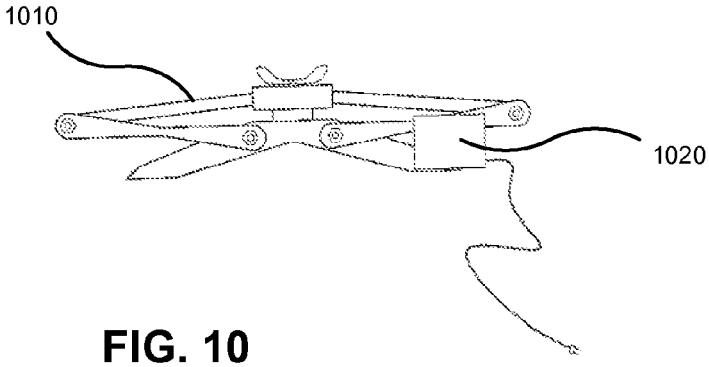
FIG. 10 illustrates an electrical scissor jack lifting assembly, in accordance with an embodiment of the invention.

For example, FIG. 8 illustrates a hydraulic jack lifting assembly, in accordance with an embodiment of the invention. The hydraulic jack comprises a body section 810 and an internal piston 820. When the hydraulic jack receives a pressurized fluid from a hose 830, typically coupled to a hydraulic pump (not shown), the fluid pressure is applied to the internal piston. Another type of jacking system is illustrated in FIG. 9, which depicts an embodiment of an air-inflatable jack lifting assembly. These jacks comprise inflatable air bags 910 that use air pressure to create the desired lifting when the bag 910 is inflated. An air pump 920 supplies and regulates the air pressure within the bag 910 to control the lifting. The bags 910 may be stacked to increase their effective lifting capability. Yet another type of jack is an electrical scissor jack 1010, an embodiment of which is illustrated in FIG. 10. The electrical scissor jack 1010 uses an electrical motor 1020 to actuate a horizontal screw, which closes the scissor legs and elevates the jack to provide the desired lift. Scissor-type jacks may be actuated by other means, including mechanically.

Adjusting the Height of a Suspended Slab

An embodiment of the invention allows for simple and inexpensive future adjustments to the slab's height, as needed. Although some foundation repair systems may allow for limited adjustment of a slab at perimeter piers (and at significant expense), they have no provision for adjusting the slab over interior pier supports. Embodiments of the invention thus allow for the slab to be adjusted over interior piers as easily as over perimeter piers.

The adjustments are relatively simple to make in all embodiments for new construction and for repair or improvement (retrofit) of existing foundations. The height of the foundation at any or all piers can be adjusted in either direction by removing the protective cap, accessing the lifting bolts, and turning them up or down to adjust the elevation of the affected portion of the slab. It is even possible to set the foundation back to the grade, remove the bolt and install longer bolts to obtain even higher adjustments.

Seismic Damping for a Suspended Foundation

Figure 11:
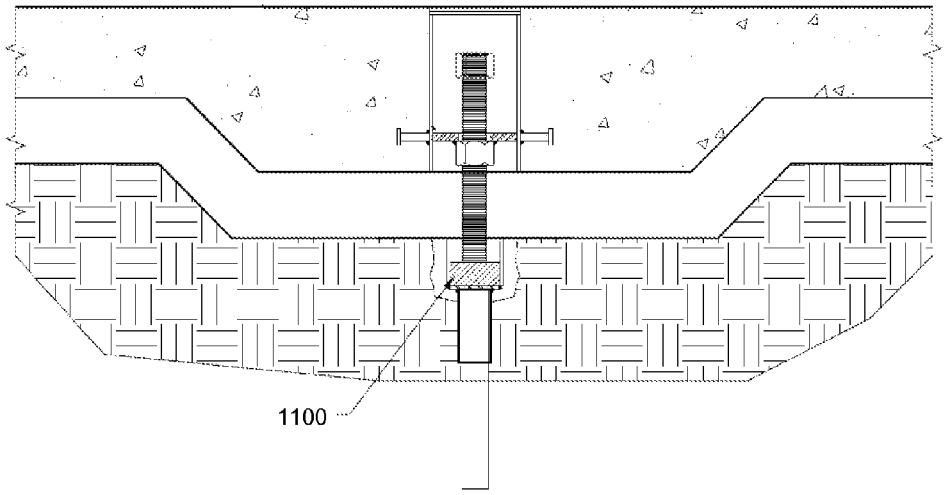
FIG. 11 illustrates a suspended slab foundation including a seismic damper, in accordance with an embodiment of the invention.

As illustrated in FIG. 11, a suspended foundation may include a seismic damping system to isolate the foundation—and thus the structure built thereon—from seismic activity in the ground. In one embodiment, a new foundation is formed as described above, except that a seismic damper 1100 is installed on top of pier so that the lifting bolt rests on the seismic damper 1100 instead of the pier. In this manner, the entire structure can be partially isolated from ground movement, depending on the effectiveness of the damper 1100. In another embodiment, an existing foundation is seismically retrofitted by installing piers and lifting assemblies for an existing foundation as described above, except that a seismic damper 1100 is installed on top of each pier so that the lifting bolt rests on the seismic damper 1100.

In this way, residential and commercial constructions can be protected from seismic forces. This technique is more economical than many existing solutions.

Suspended Plumbing for Sanitary Sewer Piping

Figure 12A:
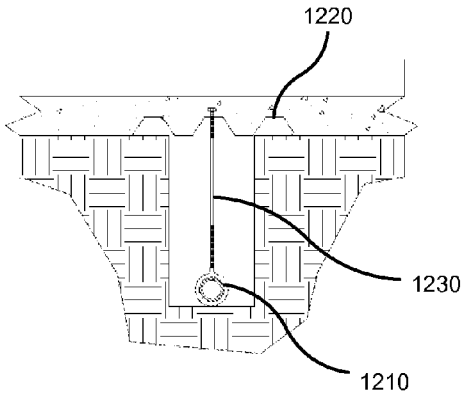
FIGS. 12A and 12B illustrate a suspended slab foundation with isolated plumbing, in accordance with an embodiment of the invention.
Figure 12B:
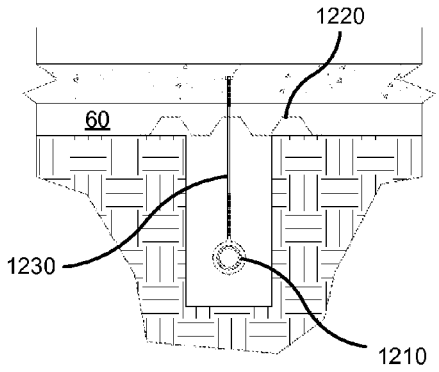

FIGS. 12A and 12B illustrate one embodiment for a method of suspending sewer plumbing from the bottom of a slab so that the sewer plumbing is isolated from future ground movement just like the foundation itself. As illustrated, the sewer piping 1210 is installed as it would be installed on a normal structure. But instead of bedding the pipe 1210 in the ditch, the plumbing ditch is left open and is covered with corrugated metal 1220. Commercial type pipe hangers 1230 are installed at a proper spacing, and the threaded ends of the hangers 1230 are extended through holes drilled in the corrugated metal 1220. Because the ends of the hangers 1230 extend into the volume of the concrete slab, these threaded ends are embedded into the concrete slab when the concrete is poured. In one embodiment, a nut is threaded over the ends of the hangers 1230 to help secure the pipe hangers 1230 in the concrete.

When the slab is raised, as discussed above, the entire sewer plumbing 1210 is raised by the same amount. The final connection is made between the sewer pipe 1220 exiting the foundation and the main sewer pipe at the street after the foundation is raised.

Repairing and/or Retrofitting an Existing Foundation

Figure 13:
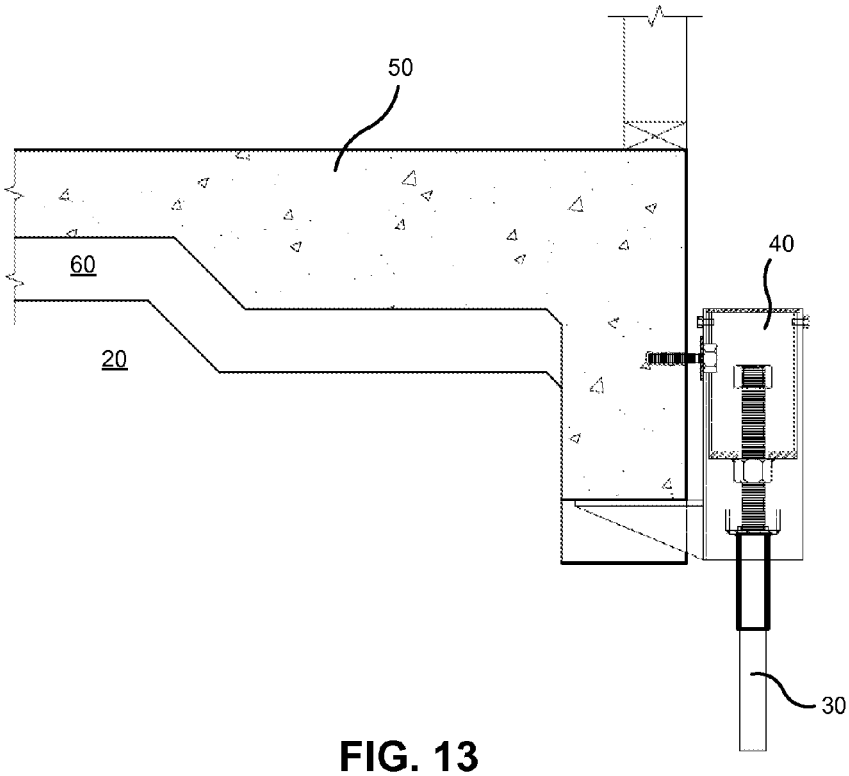
FIG. 13 is a cross sectional view of the perimeter of a slab retrofitted with a lifting mechanism, in accordance with an embodiment of the invention.

An existing foundation can also be repaired and/or retrofitted using lifting assemblies and techniques similar to that described above. FIG. 13 illustrates a lifting mechanism 40 installed into the existing slab 50 in the perimeter of a structure, in accordance with one embodiment of the invention. Before the lifting assemblies 40 are put in place, a number of piers 30 are installed into the stable soil 20 around the perimeter of the foundation. The piers may be concrete, helical, pressed concrete, or steel piers, or any other appropriate type of support structure may be used under the lifting mechanism 40. To install each lifting assembly 40, in one embodiment, the lifting assembly 40 is slipped inside of an additional pipe sleeve, and the lifting assembly 40 and additional pipe sleeve are secured together with set screws. The additional pipe has a flange welded to one side that slips under the bottom of the perimeter grade beam. The lifting assembly 40 is then secured on top of the pier 30 so that a lifting bolt may be screwed therethrough to lift the structure, as described above.

Figure 14:
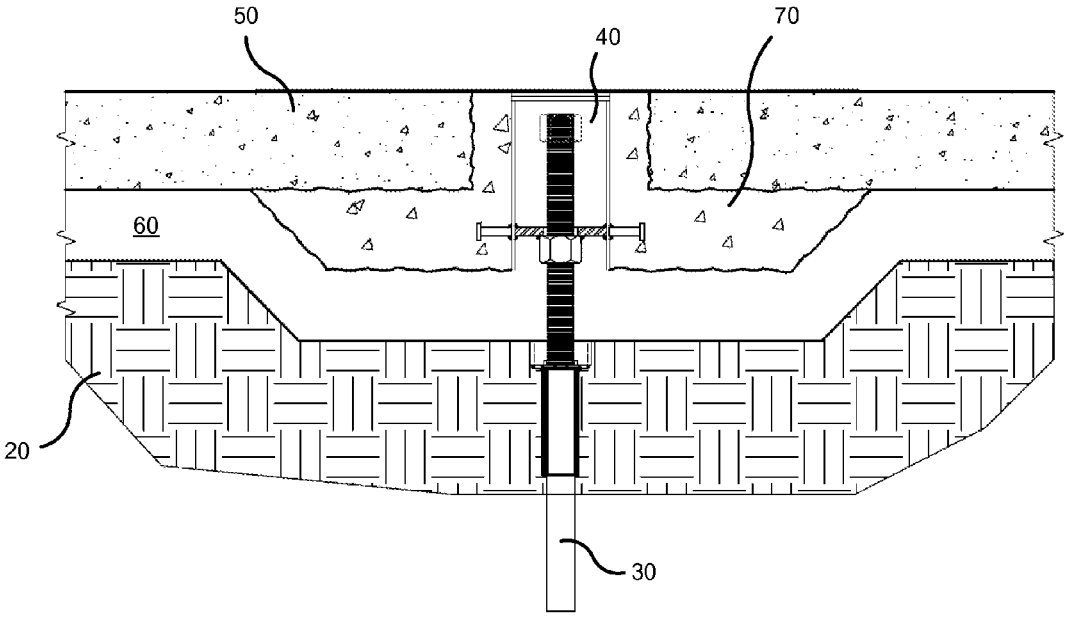
FIG. 14 is a cross sectional view of an interior portion of a slab retrofitted with a lifting mechanism, in accordance with an embodiment of the invention.

FIG. 14 illustrates a method for installing a lifting mechanism 40 into the existing slab 50 in the interior of a structure, in accordance with one embodiment of the invention. In this case, a hole of sufficient diameter is first cored through the slab 50, and then some type of pier 30 or other support structure is installed through the hole and into the stable soil 20. A portion of the soil 20 under the slab surrounding the hole is removed, and the lifting assembly 40 is then set in place on top of the pier 30. New concrete 70 is poured around the mechanism and into the void created by the removal of the soil. Once the new concrete 70 is sufficiently hardened, a lifting bolt can be used to lift the structure, as described above. If needed, tensile strengthening of the concrete can be accomplished by applying composite fiber reinforcement to the top surface of the concrete, in the area over each pier. The lifting bolts for the perimeter and interior lifting structures can be accessed in the future for additional adjustments to the foundation.

Applications

As will be appreciated to those of skill in the art, the embodiments described herein for forming new foundations for structures and repairing or retrofitting existing ones have useful applications in a number of environments and situations. Listed below are some of the possible applications and benefits for the embodiments described above.

Active Soils (High PI and PVR): To eliminate soil movements within the foundation.

Low Bearing Capacity Soils: Allows piers to support foundation and does not require bearing of surface soils.

Chemical Soil Reactions: Provide an air space between the soil and foundation to eliminate concrete corrosion due to high concentration of sulfate or other chemical compounds.

Ventilation: Provides the ability to ventilate under the foundation for remediation of gases, such as radon.

Frost Heave: Provides a means of isolating the foundation from frost heave induced stresses.

Non-Compacted Soils: Soils that are not compacted at the surface, the piers support all of the foundation forces thus eliminating the need to compact the soils.

Seismic Forces: Minimizes seismic forces on the structure.

Lack of Geotechnical Data: Where no geotechnical data is available or where data cannot be obtained.

Ventilation: Provides the ability to ventilate under the foundation for remediation of gases, such as radon.

Slope stability: Where slope stability is questionable.

Stable/acceptable soil conditions, but excessive slope on pad site.

Required Adjustability: Provides the ability to adjust a structural foundation on an as needed basis to meet specifications of mechanical or other type equipment.

Time Savings: Reduces construction time.

Greater quality control.

Greater control over construction tolerances.

Cost Savings: Significantly less expensive than traditional suspended slab techniques and approximately the same costs for a slab on grade foundation.

Significant reduction of warranty issues and cost of warranty insurance.

Summary

The foregoing description of the embodiments of the invention has been presented for the purpose of illustration; it is not intended to be exhaustive or to limit the invention to the precise forms disclosed. Persons skilled in the relevant art can appreciate that many modifications and variations are possible in light of the above teachings. It is therefore intended that the scope of the invention be limited not by this detailed description, but rather by the claims appended hereto.

What is claimed is:

1. A method for forming a foundation of a structure suspended above a ground surface, the method comprising:

placing a plurality of structural supports in the ground surface;

mechanically coupling a lifting assembly to each of the structural supports;

forming a slab that extends over the plurality of structural supports, the slab comprising a ground floor foundation of a structure, wherein each lifting assembly comprises an anchor portion cast in the slab and an interface portion that is mechanically coupled to a structural support; and before movement of the ground surface below the slab, actuating the lifting assemblies to raise the slab above the ground surface.

2. The method of claim 1, wherein one or more of the structural supports comprise a pier.

3. The method of claim 1, wherein one or more of the structural supports comprise a helical pier.

4. The method of claim 1, wherein one or more of the structural supports comprise a drilled shaft pier.

5. The method of claim 1, wherein one or more of the structural supports comprise a spread footing.

6. The method of claim 1, wherein one or more of the structural supports comprise a pressed concrete or steel piling.

7. The method of claim 1, wherein the lifting assemblies are adapted to be actuated by turning a lifting bolt to raise the slab from the support structure.

8. The method of claim 1, wherein one or more of the lifting assemblies comprise a jack.

9. The method of claim 8, wherein the jack is selected from the group consisting of: a hydraulic jack, an air-inflatable jack, and an electric scissor jack.

10. The method of claim 1, wherein actuating the lifting assemblies is performed by an automatic lifting system coupled to control actuation of the lifting assemblies simultaneously.

11. The method of claim 10, wherein actuating the lifting assemblies comprises controlling the automatic lifting system using a feedback signal based on measured elevations of the slab.

12. The method of claim 1, further comprising:

coupling a seismic damper between the support structures and the slab to isolate partially the slab from seismic movement in the ground.

13. The method of claim 1, further comprising:

suspending plumbing from the slab before actuating the lifting assemblies to raise the slab.

14. The method of claim 13, wherein suspending plumbing from the slab comprises:

laying plumbing in a ditch below the slab to be formed before forming the slab;

attaching the plumbing to the slab; and raising the plumbing by lifting of the slab.

15. The method of claim 1, further comprising:

lowering the slab by unscrewing a lifting bolt;

replacing the lifting bolt with a lifting bolt of a different length; and raising the slab by turning the new lifting bolt.

16. A height-adjustable, structurally suspended slab system for a structural foundation, the system comprising:

a slab comprising a ground floor foundation of a structure, wherein the slab comprises concrete that is reinforced to support a building structure thereon;

a plurality of structural supports for supporting the slab, the structural supports capable of being fixed in a ground surface; and for each structural support, a lifting assembly that comprises an anchor portion cast in the slab and an interface portion coupled to the structural support, wherein each lifting assembly is adapted to be actuated to raise the slab above the ground surface to create a void thereunder.

17. The system of claim 16, wherein at least some of the structural supports comprise a pier selected from a group consisting of: a helical pier and a drilled shaft pier.

18. The system of claim 16, wherein at least some of the structural supports comprise a spread footing.

19. The system of claim 16, wherein the lifting assemblies are actuated by turning a lifting bolt to raise the slab from the support structure.

20. The system of claim 16, further comprising:

an automatic lifting system coupled to control actuation of the lifting assemblies.

21. The system of claim 20, wherein the automatic lifting system includes one or more elevation sensors, and the automatic lifting system uses measured elevations from the sensors as a feedback signal to control actuation of the lifting assemblies.

22. The system of claim 16, further comprising:

a seismic damper coupled between each of the support structures and the slab for partially isolating the slab from seismic movement in the ground.

23. The system of claim 16, further comprising:

plumbing suspended from the slab.

24. A suspended slab system for a structural foundation, the system comprising:

a slab comprising a ground floor foundation of a structure, wherein the slab comprises concrete that is reinforced to support a building structure thereon;

a means for supporting the slab over a pad site; and a means, coupled to the means for supporting, for lifting the slab above the ground surface to create a void thereunder, wherein the means for lifting is mechanically coupled between an element cast in the slab and the means for supporting the slab.

25. The system of claim 24, further comprising:

an automatic lifting system coupled to control actuation of the means for lifting.

26. The system of claim 25, wherein the automatic lifting system includes one or more elevation sensors, and the automatic lifting system uses measured elevations from the sensors as a feedback signal to control actuation of the means for lifting.

27. The system of claim 24, further comprising:

a seismic damper coupled between the means for supporting and the slab for partially isolating the slab from seismic movement in the ground.

28. The system of claim 24, further comprising:

plumbing suspended from the slab.

* * * * *